United States Patent [19]

Hanas et al.

[11] Patent Number: 4,469,162

[45] Date of Patent: Sep. 4, 1984

[54] CONTINUOUS CASTING TEMPERATURE CONTROL APPARATUS

[75] Inventors: Bertil Hanas, Vesteras, Sweden; Gunter Rudolph, Jork, Fed. Rep. of Germany

[73] Assignee: Asea Akt, Vesteras, Sweden

[21] Appl. No.: 551,519

[22] Filed: Nov. 16, 1983

Related U.S. Application Data

[63] Continuation of Ser. No. 291,872, Aug. 10, 1981, abandoned, which is a continuation of Ser. No. 47,642, Jun. 11, 1979, abandoned.

[30] Foreign Application Priority Data

Jun. 13, 1978 [SE] Sweden ..... 7806798

[51] Int. Cl.[3] ..... B22D 11/10; B22D 11/16

[52] U.S. Cl. ..... 164/154; 141/82; 164/453; 222/593

[58] Field of Search ..... 164/453, 154; 222/593, 222/146 AE; 141/82

[56] References Cited

U.S. PATENT DOCUMENTS 3,435,992 4/1969 Tisdale et al. ..... 222/593 X 3,570,713 3/1971 Tromel ..... 222/593 X 3,848,072 11/1974 Dershem et al. ..... 222/593 X

FOREIGN PATENT DOCUMENTS 704620 2/1954 United Kingdom ..... 222/593

OTHER PUBLICATIONS

*Continuous Casting of Steel*, ed. by C. Moore et al., Noyes Data Corp., Park Ridge, New Jersey, pp. 116–121.

*Primary Examiner*—Nicholas P. Godici
*Assistant Examiner*—J. Reed Batten, Jr.
*Attorney, Agent, or Firm*—Watson, Cole, Grindle & Watson

[57] ABSTRACT

The invention relates to a mechanism for continuous casting, such as from a melt container. Between the melt container and the casting mold there is arranged an intermediate ladle having a heating device and an outlet to the mold as well as an indicator for predicting the temperature in the melt container. The output signal of the indicator is adapted to be compared with a desired value signal to obtain a comparison signal to control the heating device for substantially constant temperature at the outlet of the intermediate ladle.

5 Claims, 6 Drawing Figures

$T_{in}$
23
25
3'
22
$T_{0in}$
4
24
$\Delta T_{in}$
21
17'
17''
17'''
17
18
19
20
$P_f$
33
32
$P_{ind}$
6
$\dot{m} \times c_p (T_{out} - T_{in})$
31
30
$T_{out} - T_{in}$
28
27
26
$T_{out}$
30'
29

CONTINUOUS CASTING TEMPERATURE CONTROL APPARATUS

This application is a continuation of application Ser. No. 291,872, filed Aug. 10, 1981 which in turn is a continuation of application Ser. No. 47,642 filed June 11, 1979, both now abandoned.

BACKGROUND OF THE INVENTION

1. Field of the Invention

The present invention relates to a means for continuous casting, for example from a melt container, and more particularly to such casting apparatus in which heating means are controlled to maintain the temperature at the output of an intermediate ladle within a specified range.

2. Prior Art

In continuous casting the temperature is of importance to obtain a desired solidification configuration. During normal casting of steel or iron, the temperature usually drops 20° C., sometimes 30° C., i.e. $\Delta T = \pm 15°$ C. It would be desirable for $\Delta T$ to be kept at $\pm 5°$ C. at the most, which would considerably improve the quality of the casting and the cast object and the result would become more reliable. This limit applies when stirrers are used. When no stirrers are used, still closer margins are required.

SUMMARY OF THE INVENTION

The temperature in the melt container falls according to a known curve as shown by numeral 1 in FIG. 2. The invention utilizes that fact to obtain a substantially constant temperature at the inlet of the casting mold in a continuous casting apparatus. A feature of the invention is that between the melt container and the casting mold there is arranged an intermediate ladle having heating means and an outlet to the mold as well as an indicator device for predicting the temperature of the melt in the melt container as a function of time. The device indicator consists of a device for predicting the temperature drop in the melt container during the casting process. The output signal from the predicted value indicator is compared with a desired value signal to generate a comparison signal for maintaining a substantially constant melt temperature at the outlet of the intermediate ladle. The comparison signal controls the heating means. Thus, a substantially constant ($\leqq \pm 5°$ C.) temperature can be obtained at the outlet of the intermediate ladle by controlling the heating in this way.

Starting from the predicted amount of temperature decrease and the constant desired temperature value, it is thus possible to estimate the heat requirement, which of course is not constant during the casting process, and arrive at a substantially constant outlet temperature from the intermediate ladle. The predicted curve should suitably be successively controlled, for example by controlling the temperature on different occasions, and in this way a very exact prediction curve can be achieved, which corresponds to the actual vaue of the temperature in the melt container. This method of prediction thus eliminates the difficulties which normally exist in measuring the temperature in a melt container of this kind.

BRIEF DESCRIPTION OF THE DRAWINGS

The casting furnace is exemplified in the accompanying Figures, in which.

Figure 1:
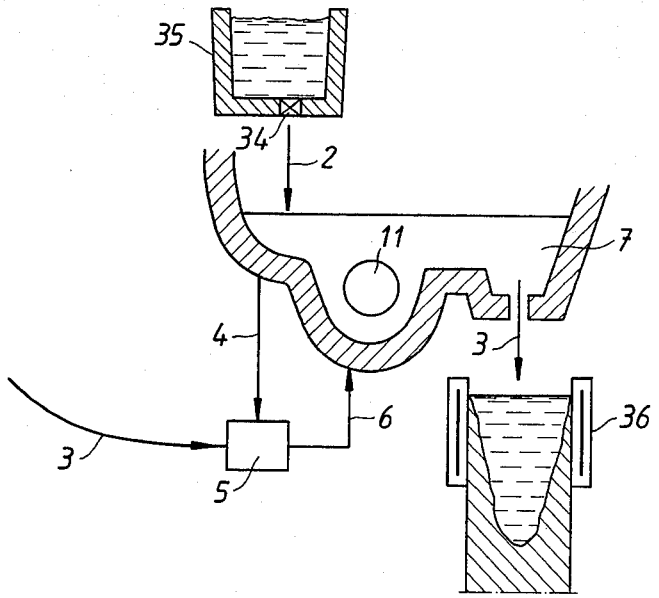
FIG. 1 shows a low-frequency channel furnace having inlet, outlet and predicting means.

DETAILED DESCRIPTION in FIG. 1 arrow 2 indicates the place where melt is tapped from a melt container 35 having teeming outlet 34 and located at a preceding stage, and arrow 3 indicates the teeming outlet from the intermiediate ladle into the casting mold 36. The predicted temperature signal, which is equal to or represents the actual value temperature signal in the preceding melt container predicts the actual melt temperature in melt container 35 and is shown at 3' and at 4 an intermittent or continuous temperature signal is supplied, corresponding to the actual temperature value in the intermediate ladle. It is thus possible to change the predicted temperature curve in controller 5. A reference signal 6 is supplied to an inductive heating device 11, the power of which can be controlled in the usual manner so that a constant temperature can be obtained during the tapping at teeming outlet 3. The furnace for the heating is proposed, as shown in FIG. 1, to be designed as a separate low-frequency channel inductor, and it is mounted directly in the intermediate ladle in such a way that the steel flows through it and out into distributing box 7. It is possible, for example, to use a vertical channel, as shown in FIG. 1, or horizontal channels as in the case of a two-chamber furnace.

Figure 2:
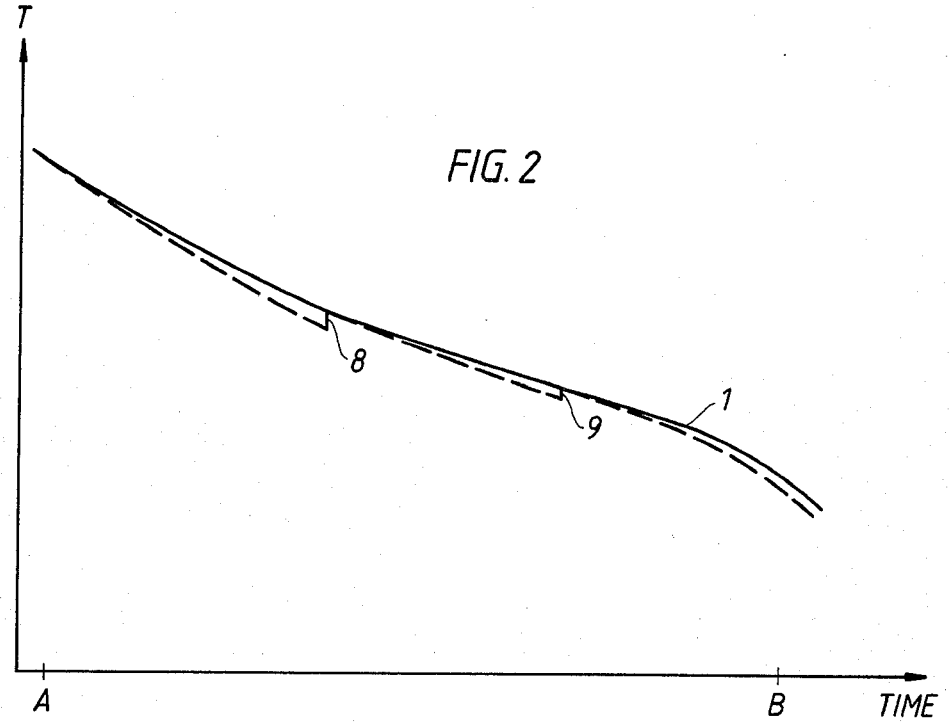
FIG. 2 is the prediction curve.

FIG. 2 shows a predicted typical temperature fall curve 1, and from the start of the process at A until its end at B a considerable reduction of the temperature is visible, for example between 20° and 30° C. for a casting operation comprising 100 minutes. Thus, it is necessary to initially measure the temperature in the melt container, as the temperature cooling curve can be predicted as shown at 1 by using a heat balance model. By intermittently controlling the temperature in the intermediate ladle (FIG. 1), the predicted curve can be adjusted (for example at points 8 and 9), whereby the predicted temperature curve can be improved to correspond relatively exactly to the actual temperature value in the preceding casting ladle or as shown in FIG. 1, melt container 35. It is thus desirable to control the inductor heating power so that the output temperature of the steel during the tapping from the intermediate ladle output 3, i.e. at distributing box 7, is constant.

The temperature of the incoming steel varies depending on the heat losses from the melt container 35, and the heat losses depend on a number of factors, such as the thickness of the slag cover, the thickness of the furnace lining and the degree of preheating of the melt container 35. As it may sometimes be difficult to be able to estimate the exact end temperature with any major precision using a heat balance model for the melt container 35, corrections have to be made, as shown in FIG. 2. These corrections are made depending on the casting rate, i.e. holding time of the steel in the melt container 35, in the shown case between A and B 100 minutes. At the points of measurement 8 and 9 a subsequent correction of the predicted curve 1 is done.

Figure 3:
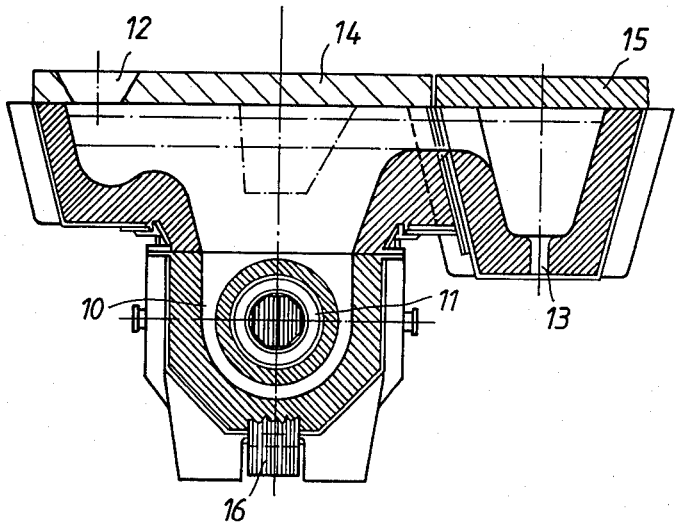
FIGS. 3 to 5 show an example of a heating device and an intermediate ladle in a plant according to the invention.
Figure 4:
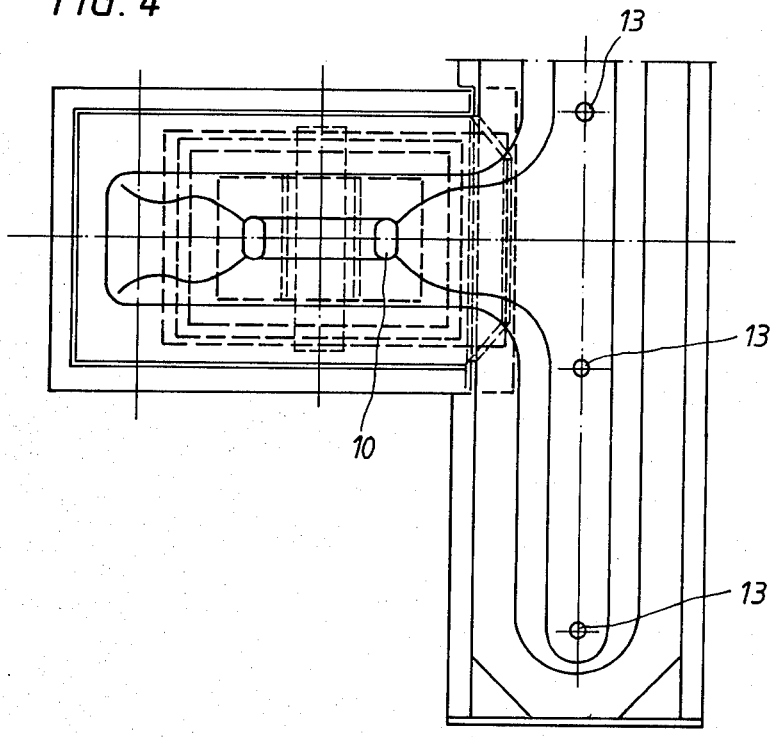
Figure 5:
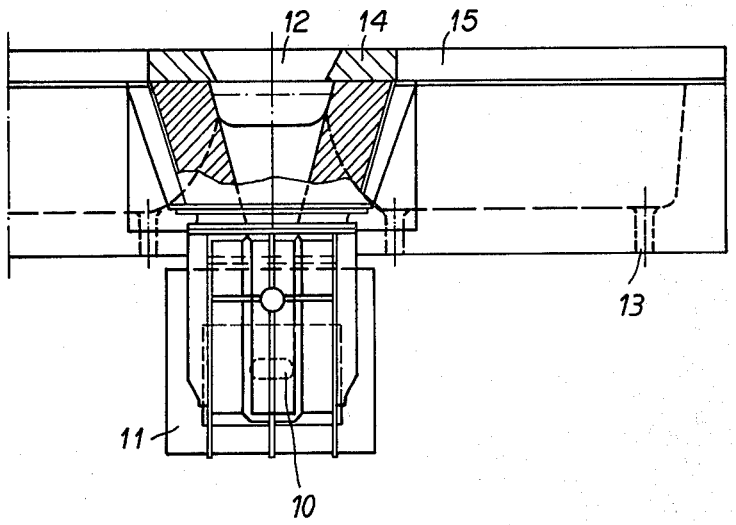

FIGS. 3 to 5 show an intermediate ladle having vertical channels 10, and primary heating coil 11, to which the supplied power is adapted to be controlled. Pouring of melt from a preceding melt container such as melt container 35, the actual temperature value of which is predicted by a curve such as depicted in FIG. 2, is shown at 12, and discharge of melt takes place at 13. As shown in FIG. 4 the discharge takes place at several outlets 13, and the number of outlets may be course vary between one and a very great number. The intermediate ladle is provided with lid 14 and the distributing channel is also provided with lid 15. Numeral 16 denotes the iron core (yoke) of the low-frequency channel furnace.

Figure 6:
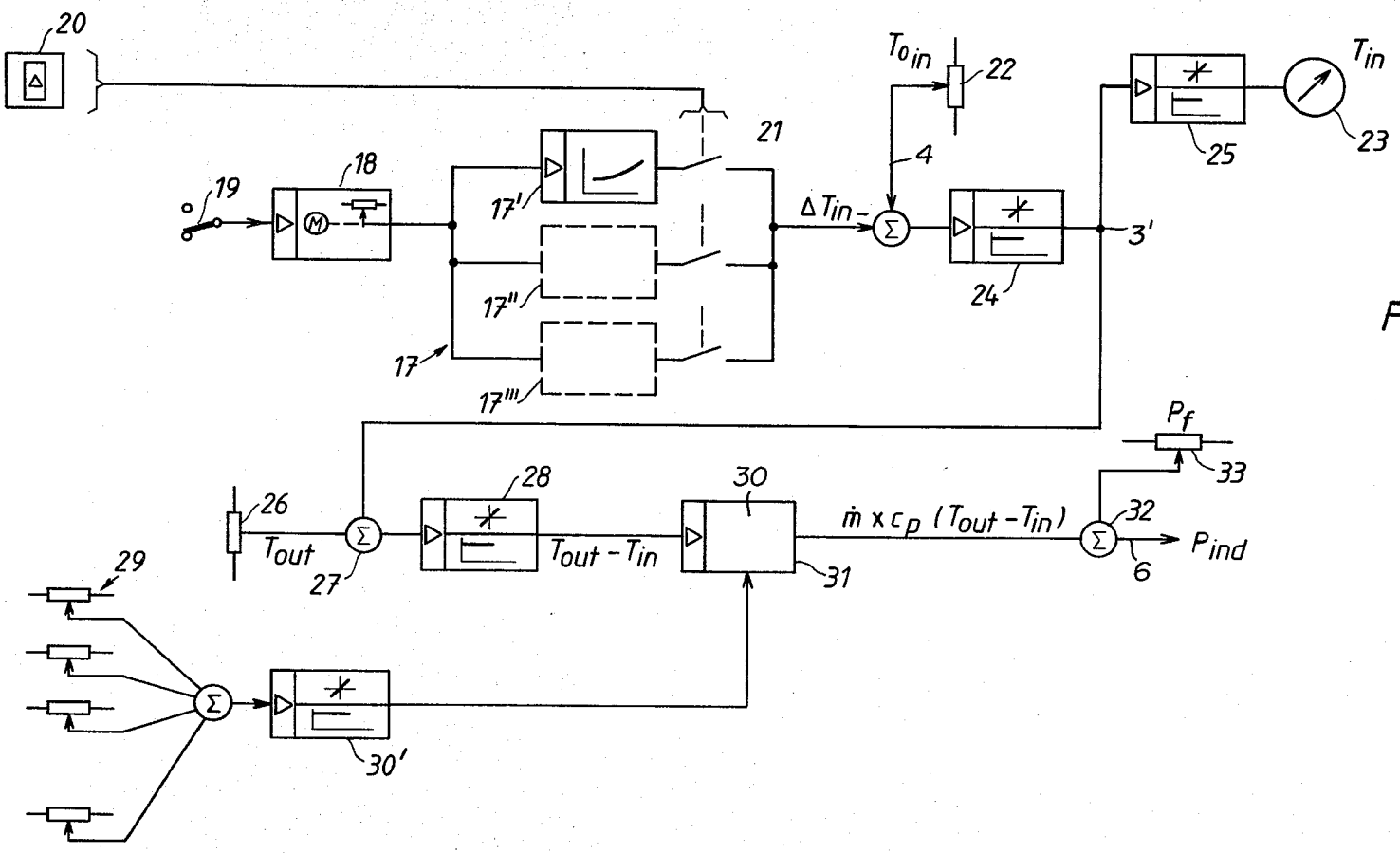
FIG. 6 is an embodiment of the control equipment for the apparatus of the invention.

FIG. 6 illustrates an embodiment of controller 5 shown in FIG. 1. The temperature drop in melt container 35 is predicted in predicting means 17, combined with a motor driven potentiometer 18, provided with switch means 19 for start and return operation. Potentiometer 18 provides a time function which, in predicting means 17, gives the predicted temperature drop in melt container 35 as shown in FIG. 2.

The temperature function for controlling a specific casting operation may be chosen by selector 20, which switches in the desired predicted temperature drop function from one of several different temperature functions 17', 17'', or 17''' by switch means 21.

In potentiometer 22 the melt (steel) temperature $To_{in}$ is adjusted, i.e. the melt temperature at the beginning of the casting operation in melt container 35. When the casting starts, motor driven potentiometer 18 starts, and the predicted temperature change $\Delta T_{in}$ is added to $To_{in}$, which gives the expected or predicted melt (steel) temperature $T_{in}$. This value is equal to the actual value temperature signal 3' shown in FIG. 1, and is indicated on measuring instrument 23 through amplifiers 24, 25. Instrument 23 may be selected for the temperature range 1550°–1700° C.

$T_{in}$ representing signal 3' is compared with a reference value $T_{ref}$ corresponding to a desired constant melt temperature $T_{out}$ obtained from potentiometer 26 in summation device 27, and the difference $T_{out}$-$T_{in}$, after amplification in amplifier 28, is multiplied by $m \times c_p$, where m is the casting mass flow rate, and $c_p$ is a constant value for the melt material. (m may be obtained from the casting tachometer at a constant level in the preceding melt container.) The value, $m \times c_p$, may be obtained from potentiometer device 29, amplified at 30'.

The value $m \times c_p(T_{out}-T_{in})$ may be obtained in multiplier 31, the output of which is added in summation device 32 to a reference value $P_f$ (from potentiometer 33), and a reference value $P_{ind}$ corresponding to signal 6 in FIG. 1 is obtained for the heating means 11 in the intermediate ladle (see FIG. 1).

In order to control $T_{in}$, temperature measuring in the intermediate ladle takes place on several occasions during one casting operation. If $T_{in}$, the predicted melt temperature in melt container 35, deviates from the measured $T=T_m$, which corresponds to signal 4 in FIG. 1, potentiometer 22 may be adjusted in such a manner that $T_{in}=T_m$. (See FIG. 2 showing the adjustments at 8 and 9.)

When the casting is over, motor driven potentiometer 18 is driven backwards at 19 and the equipment is ready for the next casting.

What is claimed is:

1. Continuous casting apparatus, comprising:

a melt container for retaining molten metal;

a casting mold for molding said molten metal;

an intermediate ladle connected between said melt container and said casting mold and including means for heating the metal therein; and means for generating a control signal for controlling said means for heating to maintain the temperature of the molten metal at the outlet of said intermediate ladle within a specified range and including means for predicting the temperature within said melt container, means providing a signal representing the desired temperature of the molten metal delivered from said intermediate ladle to said casting mold, means for comparing said predicted temperature and said desired temperature signal to generate a difference signal, and means responsive to said difference signal to generate said control signal.

2. Apparatus as in claim 1 wherein said intermediate ladle includes a channel and said heating means is a primary induction coil mounted within said channel.

3. Apparatus as in claim 1 wherein said means for predicting includes means for generating a plurality of predicted temperature drop functions and switching means for connecting a selected one of said predicted temperature drop functions to said means for comparing.

4. Apparatus as in claim 3 wherein said means for predicting further includes a variable potentiometer for generating an initial melt temperature and means for periodically subtracting from said initial melt temperature a predicted temperature decrease to obtain a predicted temperature within said melt container, and said desired temperature signal is generated by a variable potentiometer, said means for comparing includes a summation device for obtaining the difference between said desired temperature signal and said predicted temperature to generate said difference signal.

5. Apparatus as in claim 4 wherein said means for comparing further includes means for multiplying said difference signal by the casting rate and a constant representative of the characteristics of the molten metal.

* * * * *